US009920938B2

(12) United States Patent
Chaudhry et al.

(10) Patent No.: US 9,920,938 B2
(45) Date of Patent: Mar. 20, 2018

(54) PACKAGED TERMINAL AIR CONDITIONER UNIT

(71) Applicant: General Electric Company, Schenectady, NY (US)

(72) Inventors: Gunaranjan Chaudhry, Bangalore (IN); Brent Alden Junge, Evansville, IN (US); Michael John Kempiak, Osceola, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 237 days.

(21) Appl. No.: 14/691,612

(22) Filed: Apr. 21, 2015

(65) Prior Publication Data

US 2016/0313013 A1 Oct. 27, 2016

(51) Int. Cl.
*F24F 1/02* (2011.01)

(52) U.S. Cl.
CPC ..... *F24F 1/027* (2013.01)

(58) Field of Classification Search
CPC ..... F24F 1/027; F25B 43/00; F25B 13/00; F25B 41/00; F25B 2400/23; F25B 2400/0409; F25B 2341/0014; F25B 41/067; F25B 2341/061
USPC ..... 62/499–500
See application file for complete search history.

(56) References Cited

U.S. PATENT DOCUMENTS 2,978,881 A * 4/1961 Alsing ..... F24F 1/02 62/160
3,496,992 A * 2/1970 Leonard, Jr. ..... F24F 5/00 165/62
3,500,656 A * 3/1970 Coggburn ..... F25B 41/00 62/196.2
4,551,983 A * 11/1985 Atsumi ..... F25B 41/00 62/174
6,425,249 B1 * 7/2002 Cho ..... F25B 41/00 62/324.6
6,550,265 B2 * 4/2003 Takeuchi ..... F25B 9/008 62/116
6,584,794 B2 * 7/2003 Takeuchi ..... F25B 41/00 62/278
2002/0066278 A1 * 6/2002 Cho ..... F25B 6/04 62/114
2003/0167792 A1 * 9/2003 Cho ..... B60H 1/3204 62/500
2004/0211199 A1 * 10/2004 Ozaki ..... F25B 9/008 62/170
2007/0074536 A1 * 4/2007 Bai ..... F25B 9/006 62/513

FOREIGN PATENT DOCUMENTS

JP 2004150692 A 5/2004
JP 4889714 B2 3/2012

* cited by examiner

*Primary Examiner* — Len Tran
*Assistant Examiner* — Kirstin Oswald
(74) *Attorney, Agent, or Firm* — Dority & Manning, P.A.

(57) ABSTRACT

A packaged terminal air conditioner unit is provided. The packaged terminal air conditioner unit includes a casing. A compressor, an interior coil, an exterior coil and a reversing valve are positioned within the casing. The reversing valve is configured for selectively reversing a flow direction of compressed refrigerant from the compressor. The packaged terminal air conditioner also includes at least one phase separator and at least one ejector.

17 Claims, 5 Drawing Sheets

PACKAGED TERMINAL AIR CONDITIONER UNIT

FIELD OF THE INVENTION

The present subject matter relates generally to heat pump systems, such as packaged terminal air conditioner units, and sealed systems for the same.

BACKGROUND OF THE INVENTION

Certain packaged terminal air conditioner units include a sealed system for chilling and/or heating air. The sealed systems include various components for treating a refrigerant in order to cool or heat air. The sealed system components are generally positioned within a casing that can be mounted within a wall or window of an associated building. Due to space constraints within the casing, selection of sealed system components for packaged terminal air conditioner units can be limited to relatively small components.

Packaged terminal air conditioner units are frequently classified and sold by efficiency. Customers generally prefer efficient packaged terminal air conditioner units because small improvements in heating and cooling efficiency can provide a significant reduction in utility bills. Energy efficiency in packaged terminal air conditioner units is generally a function of compressor size and efficiency, heat exchanger size, design and airflow and fan design among other factors. However, high efficiency compressors are typically very expensive, and large heat exchangers may not fit within the limited space available in the casing of a packaged terminal air conditioner unit.

Accordingly, a packaged terminal air conditioner unit with features for assisting with increasing an efficiency of the packaged terminal air conditioner would be useful. In particular, a packaged terminal air conditioner unit with features for assisting with increasing an efficiency of the packaged terminal air conditioner without requiring a high efficiency compressor and/or a large heat exchanger would be useful.

BRIEF DESCRIPTION OF THE INVENTION

The present subject matter provides a packaged terminal air conditioner unit. The packaged terminal air conditioner unit includes a casing. A compressor, an interior coil, an exterior coil and a reversing valve are positioned within the casing. The reversing valve is configured for selectively reversing a flow direction of compressed refrigerant from the compressor. The packaged terminal air conditioner also includes at least one phase separator and at least one ejector. Additional aspects and advantages of the invention will be set forth in part in the following description, or may be apparent from the description, or may be learned through practice of the invention.

In a first exemplary embodiment, a packaged terminal air conditioner unit is provided. The packaged terminal air conditioner unit includes a casing. A compressor is positioned within the casing. The compressor is operable to increase a pressure of a refrigerant. An interior coil is positioned within the casing, and an exterior coil is positioned within the casing opposite the interior coil. A phase separator is also positioned within the casing. The phase separator is configured for separating liquid refrigerant from vapor refrigerant. A reversing valve is positioned within the casing. The reversing valve is in fluid communication with the compressor in order to receive compressed refrigerant from the compressor. The reversing valve is configured for selectively directing the compressed refrigerant from the compressor to the exterior coil or the phase separator. A supply conduit extends between the exterior coil and the phase separator. An ejector is coupled to the supply conduit. A distribution conduit extends between the interior coil and the ejector. The packaged terminal air conditioner unit also includes a three-way valve. A first connection conduit extends between the phase separator and the three-way valve. A second connection conduit extends between the three-way valve and the interior coil. A third connection conduit extends between the three-way valve and the exterior coil.

In a second exemplary embodiment, a packaged terminal air conditioner unit is provided. The packaged terminal air conditioner unit includes a casing that extends between an exterior side portion and an interior side portion. A compressor is positioned within the casing. The compressor is operable to compress a refrigerant. An interior coil is positioned within the casing at the interior side portion of the casing. An exterior coil is positioned within the casing at the exterior side portion of the casing. A reversing valve is in fluid communication with the compressor in order to receive compressed refrigerant from the compressor. A phase separator is positioned within the casing. The phase separator is configured for separating liquid refrigerant from vapor refrigerant. An ejector is also positioned within the casing. The packaged terminal air conditioner unit is configured such that, in a cooling mode, a flow of liquid refrigerant from the exterior coil flows through the ejector and the ejector draws vapor refrigerant from the interior coil into the flow of liquid refrigerant and a combined flow of liquid and vapor refrigerant flows from the ejector to the phase separator. Vapor refrigerant from the phase separator also flows to the compressor and liquid refrigerant from the phase separator flows to the interior coil in the cooling mode. The packaged terminal air conditioner unit is also configured such that, in a heating mode, compressed refrigerant from the compressor flows through the phase separator and the ejector to the exterior coil.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
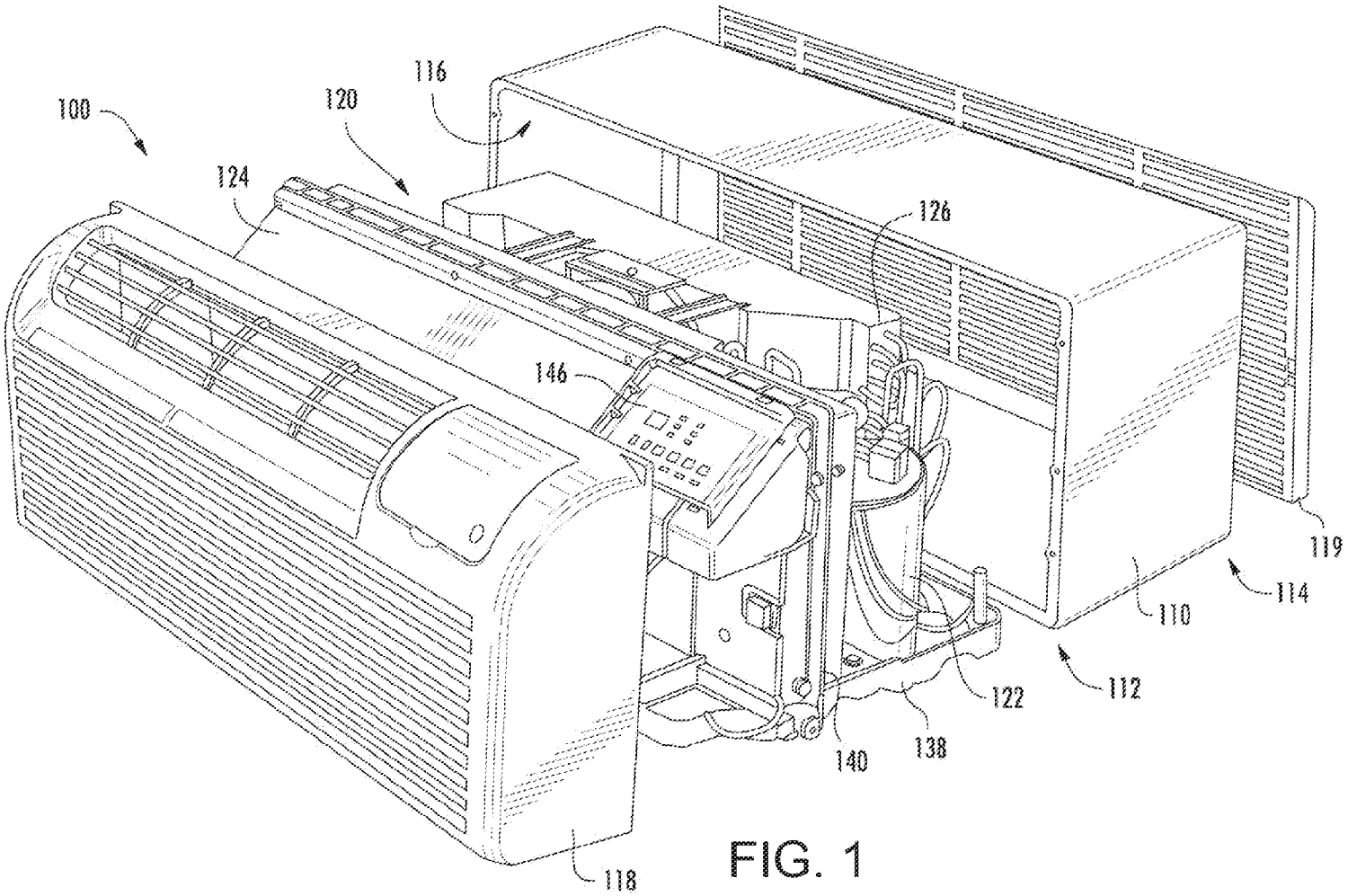
FIG. 1 provides an exploded perspective view of a packaged terminal air conditioner unit according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides an exploded perspective view of a packaged terminal air conditioner unit 100 according to an exemplary embodiment of the present subject matter. Packaged terminal air conditioner unit 100 is operable to generate chilled and/or heated air in order to regulate the temperature of an associated room or building. As will be understood by those skilled in the art, packaged terminal air conditioner unit 100 may be utilized in installations where split heat pump systems are inconvenient or impractical. As discussed in greater detail below, a sealed system 120 of packaged terminal air conditioner unit 100 is disposed within a casing 110. Thus, packaged terminal air conditioner unit 100 may be a self-contained or autonomous system for heating and/or cooling air.

As may be seen in FIG. 1, casing 110 extends between an interior side portion 112 and an exterior side portion 114. Interior side portion 112 of casing 110 and exterior side portion 114 of casing 110 are spaced apart from each other. Thus, interior side portion 112 of casing 110 may be positioned at or contiguous with an interior atmosphere, and exterior side portion 114 of casing 110 may be positioned at or contiguous with an exterior atmosphere. Sealed system 120 includes components for transferring heat between the exterior atmosphere and the interior atmosphere. For example, sealed system 120 includes a compressor 122, an interior heat exchanger or coil 124 and an exterior heat exchanger or coil 126.

Casing 110 defines a mechanical compartment 116. Sealed system 120 is disposed or positioned within mechanical compartment 116 of casing 110. A front panel 118 and a rear grill or screen 119 are mounted to casing 110 and hinder or limit access to mechanical compartment 116 of casing 110. Front panel 118 is mounted to casing 110 at interior side portion 112 of casing 110, and rear screen 119 is mounted to casing 110 at exterior side portion 114 of casing 110. Front panel 118 and rear screen 119 each define a plurality of holes that permit air to flow through front panel 118 and rear screen 119, with the holes sized for preventing foreign objects from passing through front panel 118 and rear screen 119 into mechanical compartment 116 of casing 110.

Packaged terminal air conditioner unit 100 also includes a drain pan or bottom tray 138 and an inner wall 140 positioned within mechanical compartment 116 of casing 110. Sealed system 120 is positioned on bottom tray 138. Thus, liquid runoff from sealed system 120 may flow into and collect within bottom tray 138. Inner wall 140 may be mounted to bottom tray 138 and extend upwardly from bottom tray 138 to a top wall of casing 110. Inner wall 140 limits or prevents air flow between interior side portion 112 of casing 110 and exterior side portion 114 of casing 110 within mechanical compartment 116 of casing 110. Thus, inner wall 140 may divide mechanical compartment 116 of casing 110.

Packaged terminal air conditioner unit 100 further includes a controller 146 with user inputs, such as buttons, switches and/or dials. Controller 146 regulates operation of packaged terminal air conditioner unit 100. Thus, controller 146 is in operative communication with various components of packaged terminal air conditioner unit 100, such as components of sealed system 120 and/or a temperature sensor, such as a thermistor or thermocouple, for measuring the temperature of the interior atmosphere. In particular, controller 146 may selectively activate sealed system 120 in order to chill or heat air within sealed system 120, e.g., in response to temperature measurements from the temperature sensor.

Controller 146 includes memory and one or more processing devices such as microprocessors, CPUs or the like, such as general or special purpose microprocessors operable to execute programming instructions or micro-control code associated with operation of packaged terminal air conditioner unit 100. The memory can represent random access memory such as DRAM, or read only memory such as ROM or FLASH. The processor executes programming instructions stored in the memory. The memory can be a separate component from the processor or can be included onboard within the processor. Alternatively, controller 146 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Figure 2:
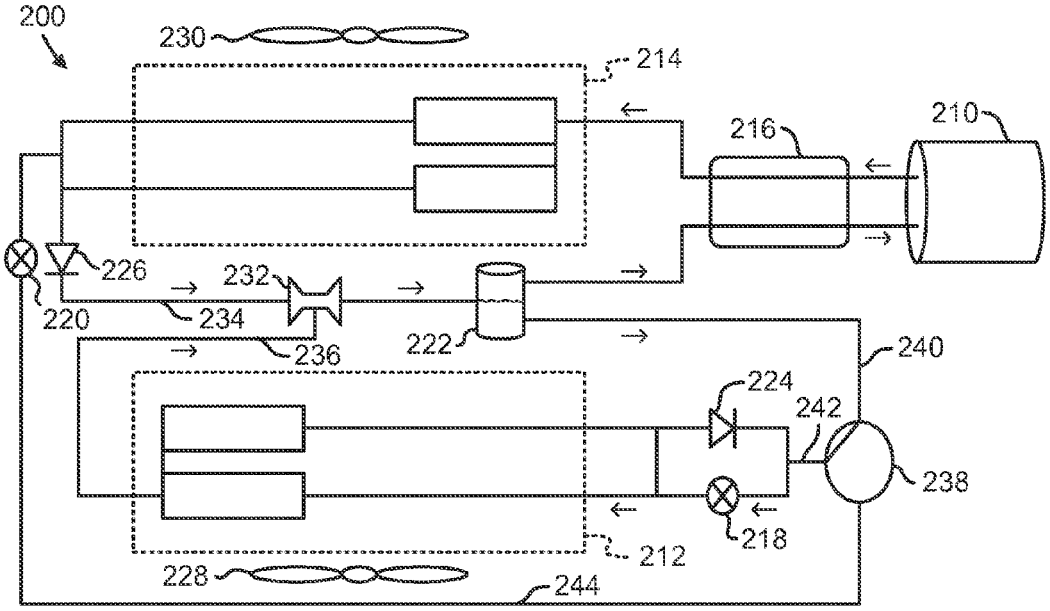
FIGS. 2 and 3 provide schematic views of components of a sealed system for a packaged terminal air conditioner unit according to an exemplary embodiment of the present subject matter.
Figure 3:
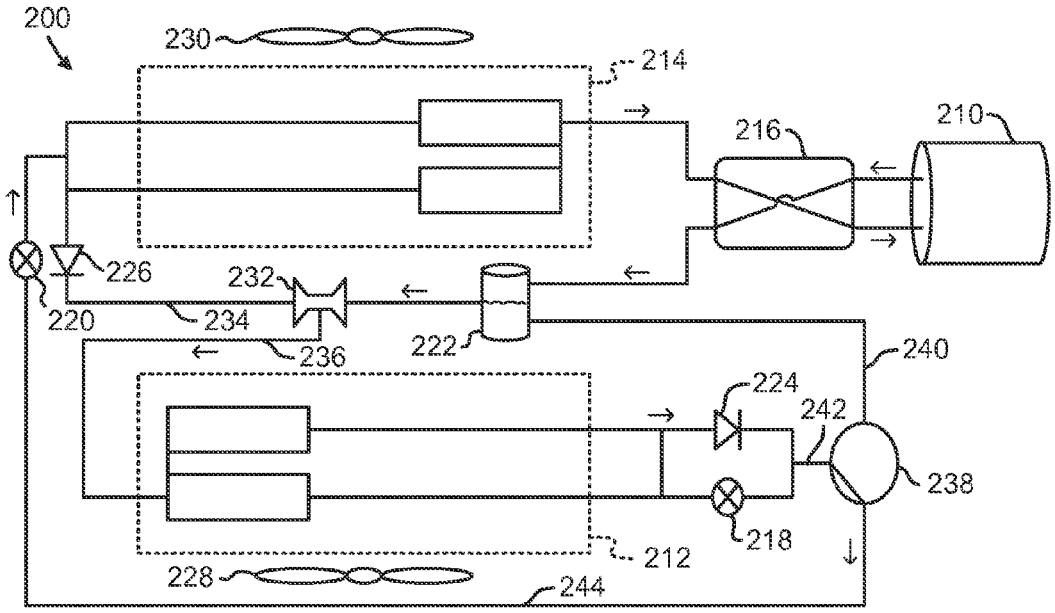

FIGS. 2 and 3 provide schematic views of components of a sealed system 200 for a packaged terminal air conditioner unit according to an exemplary embodiment of the present subject matter. Sealed system 200 may be used with or in any suitable packaged terminal air conditioner unit. For example, sealed system 200 may be used in packaged terminal air conditioner unit 100 (FIG. 1) as sealed system 120. Sealed system 200 is shown operating in a cooling mode in FIG. 2, and sealed system 200 is shown operating in a heating mode in FIG. 3. The unlabeled arrows in FIGS. 2 and 3 indicate the direction of refrigerant flow within adjacent conduits or piping of sealed system 200 in the cooling mode and heating mode, respectively.

Sealed system 200 generally operates in a heat pump cycle. Sealed system 200 includes a compressor 210, an interior heat exchanger or coil 212 and an exterior heat exchanger or coil 214. As is generally understood, various conduits may be utilized to flow refrigerant between the various components of sealed system 200, as discussed in greater detail below. Thus, e.g., interior coil 212 and exterior coil 214 may be between and in fluid communication with each other and compressor 210 via suitable tubing or piping.

As may be seen in FIGS. 2 and 3, sealed system 200 also includes a reversing valve 216. Reversing valve 216 selectively directs compressed refrigerant from compressor 210 towards either interior coil 212 or exterior coil 214. For example, in the cooling mode (shown in FIG. 2), reversing valve 216 is arranged or configured to direct compressed refrigerant from compressor 210 to or towards exterior coil 214. Conversely, in the heating mode (shown in FIG. 3), reversing valve 216 is arranged or configured to direct compressed refrigerant from compressor 210 to or towards interior coil 212. Thus, reversing valve 216 permits sealed system 200 to adjust between the heating mode and the cooling mode, as will be understood by those skilled in the art.

As shown in FIG. 2, during operation of sealed system 200, compressor 210 operates to increase a pressure of refrigerant within the compressor 210. In particular, vapor refrigerant from a phase separator 222 is directed to compressor 210 in the cooling mode. Vapor refrigerant from phase separator 222 may be a fluid in the form of a superheated vapor. Upon exiting phase separator 222, the refrigerant may enter compressor 210, and compressor 210 may operate to compress the refrigerant. Accordingly, the pressure and temperature of the refrigerant may be increased in compressor 210 such that the refrigerant becomes a more superheated vapor.

Exterior coil 214 is disposed downstream of compressor 210 in the cooling mode and acts as a condenser. Thus, exterior coil 214 is operable to reject heat into the exterior atmosphere, e.g., at exterior side portion 114 of casing 110, when sealed system 200 is operating in the cooling mode. For example, the superheated vapor from compressor 210 may enter exterior coil 214 via suitable conduit or piping that extends between and fluidly connects reversing valve 216 and exterior coil 214. Within exterior coil 214, the refrigerant from compressor 210 transfers energy to the exterior atmosphere and condenses into a saturated liquid, liquid vapor mixture and/or subcooled liquid. An exterior air handler or fan 230 positioned adjacent exterior coil 214 may facilitate or urge a flow of air from the exterior atmosphere across exterior coil 214 in order to facilitate heat transfer.

As may be seen in FIGS. 2 and 3, sealed system 200 also includes a phase separator 222 and an injector or ejector 232. Phase separator 222 is configured for separating liquid refrigerant within phase separator 222 from vapor refrigerant within phase separator 222, e.g., in the cooling mode. By separating liquid refrigerant from vapor refrigerant, phase separator 222 may improve a performance and/or efficiency of packaged terminal air conditioner unit 100, as discussed in greater detail below.

As shown in FIG. 2, in the cooling mode, phase separator 222 is fluidly coupled to exterior coil 214 via a supply conduit 234. Thus, supply conduit 234 may extend between and fluidly connect exterior coil 214 and phase separator 222 such that refrigerant from exterior coil 214 may flow through supply conduit 234 to phase separator 222. Ejector 232 is coupled to supply conduit 234 and is configured for introducing or injecting vapor refrigerant from interior coil 212 into supply conduit 234. In particular, ejector 232 may be configured for combining streams of refrigerant via the Venturi effect. Ejector 232 is positioned on supply conduit 234 and receives vapor phase refrigerant from interior coil 212 via a distribution conduit 236 that extends between and fluidly connects interior coil 212 and ejector 232. Ejector 232 directs or urges the vapor phase refrigerant from distribution conduit 236 into supply conduit 234 and refrigerant flowing through supply conduit 234.

It should be understood that phase separator 222 may be any suitable type of phase separator. For example, phase separator 222 may be constructed in the same or similar manner to the phase separator described in U.S. patent application Ser. No. 14/088,558 of Brent Alden Junge and/or the phase separator described in U.S. patent application Ser. No. 14/258,397 of Brent Alden Junge et al., both of which are incorporated by reference herein for all purposes. Within a casing of phase separator 222, liquid phase refrigerant may collect or pool at a bottom portion of phase separator 222 and vapor phase refrigerant may collect or pool at a top portion of phase separator 222, e.g., due to density differences between the liquid and vapor phase refrigerants.

Sealed system 200 also includes a three-way valve 238. Three-way valve 238 assists with switching sealed system 200 between the cooling mode and the heating mode, e.g., by modifying the flow of refrigerant between components of sealed system 200, as discussed in greater detail below. Three-way valve 238 may be configured for selectively adjusting the flow of refrigerant between a first connection conduit 240, a second connection conduit 242, a third connection conduit 244.

As may be seen in FIGS. 2 and 3, first connection conduit 240 extends between phase separator 222 and three-way valve 238, second connection conduit 242 extends between three-way valve 238 and interior coil 212, and third connection conduit 244 extends between three-way valve 238 and exterior coil 214. As shown in FIG. 2, in the cooling mode, three-way valve 238 fluidly connects first connection conduit 240 and second connection conduit 242 such that liquid refrigerant from phase separator 222 may flow from phase separator 222 to interior coil 212 via first and second connection conduits 240, 242 and three-way valve 238.

In the cooling mode, phase separator 222 receives refrigerant from supply conduit 234 and separates liquid refrigerant from supply conduit 234 and vapor refrigerant from supply conduit 234. The liquid phase refrigerant within phase separator 222 is directed from phase separator 222 to interior coil 212 via first and second connection conduits 240, 242 and three-way valve 238, as shown in FIG. 2. Conversely, the vapor phase refrigerant within phase separator 222 is directed around interior coil 212 back to compressor 210 such that the vapor phase refrigerant bypasses interior coil 212 in the cooling mode.

A first throttling device 218 is disposed on second connection conduit 242 between three-way valve 238 and interior coil 212. In the cooling mode, liquid refrigerant from phase separator 222 travels through first throttling device 218 before flowing through interior coil 212. First throttling device 218 may generally expand the refrigerant, lowering the pressure and temperature thereof. The refrigerant may then be flowed through interior coil 212. First throttling device 218 (e.g., and any other throttling device described herein) may include various components for throttling refrigerant flow through second connection conduit 242. For example, first throttling device 218 (e.g., and any other throttling device described herein) may include a capillary tube and check valve, a J-T valve, an electronic expansion valve, etc. to throttle the flow of refrigerant through second connection conduit 242, as will be understood by those skilled in the art.

Interior coil 212 is disposed downstream of first throttling device 218 in the cooling mode and acts as an evaporator. Thus, interior coil 212 is operable to heat refrigerant within interior coil 212 with energy from the interior atmosphere, e.g., at interior side portion 112 of casing 110, when sealed system 200 is operating in the cooling mode. For example, within interior coil 212, the refrigerant from first throttling device 218 receives energy from the interior atmosphere and vaporizes into superheated vapor and/or high quality vapor mixture. An interior air handler or fan 228 positioned adjacent interior coil 212 may facilitate or urge a flow of air from the interior atmosphere across interior coil 212 in order to facilitate heat transfer. As discussed above, ejector 232 directs the vapor refrigerant from interior coil 212 into supply conduit 234.

During operation of sealed system 200 in the heating mode, reversing valve 216 reverses the direction of refrigerant flow through sealed system 200, as shown in FIG. 3. Thus, in the heating mode, interior coil 212 is disposed downstream of compressor 210 and acts as a condenser, e.g., such that interior coil 212 is operable to reject heat into the interior atmosphere at interior side portion 112 of casing 110.

As may be seen in FIG. 3, phase separator 222 and ejector 232 act as conduits to direct compressed refrigerant from compressor 210 to interior coil 212 in the heating mode. A second check valve 226 on supply conduit 234 may block refrigerant flow from ejector 232 to exterior coil 214 via supply conduit 234 in the heating mode. As may also be seen in FIG. 3, three-way valve 238 fluidly connects second connection conduit 242 and third connection conduit 244 such that refrigerant from interior coil 212 may flow from interior coil 212 to exterior coil 214 via second and third connection conduits 242, 244 and three-way valve 238 in the heating mode. A first check valve 224 on second connection conduit 242 may allow refrigerant flow to bypass first throttling device 218, e.g., in the heating mode as shown in FIG. 3.

A second throttling device 220 is coupled to third connection conduit 244 between three-way valve 238 and exterior coil 214. In the heating mode, refrigerant from interior coil 212 travels through second throttling device 220 before flowing through exterior coil 214. Second throttling device 220 may generally expand the refrigerant, lowering the pressure and temperature thereof. The refrigerant may then be flowed through exterior coil 214. Second throttling device 220 may include various components for throttling refrigerant flow through third connection conduit 244. For example, second throttling device 220 may include a capillary tube and check valve, a J-T valve, an electronic expansion valve, etc. to throttle the flow of refrigerant through third connection conduit 244, as will be understood by those skilled in the art.

Exterior coil 214 is disposed downstream of second throttling device 220 in the heating mode and acts as an evaporator. Thus, exterior coil 214 is operable to heat refrigerant within exterior coil 214 with energy from the exterior atmosphere, e.g., at exterior side portion 114 of casing 110, when sealed system 200 is operating in the heating mode. For example, within exterior coil 214, the refrigerant from second throttling device 220 receives energy from the exterior atmosphere and vaporizes into superheated vapor and/or high quality vapor mixture. From exterior coil 214, refrigerant is directed back to compressor 210.

Sealed system 200 may assist with operating packaged terminal air conditioner unit 100 efficiently. For example, ejector 232 of sealed system 200 may utilize expansion work of high-pressure refrigerant to compress vapor refrigerant exiting interior coil 212 in the cooling mode. In such a manner, ejector 232 may assist with reducing energy consumption of compressor 210 in the cooling mode. Phase separator 222 also reduces a pressure drop in interior coil 212 by bypassing vapor refrigerant directly to compressor 210 in the cooling mode.

Figure 4:
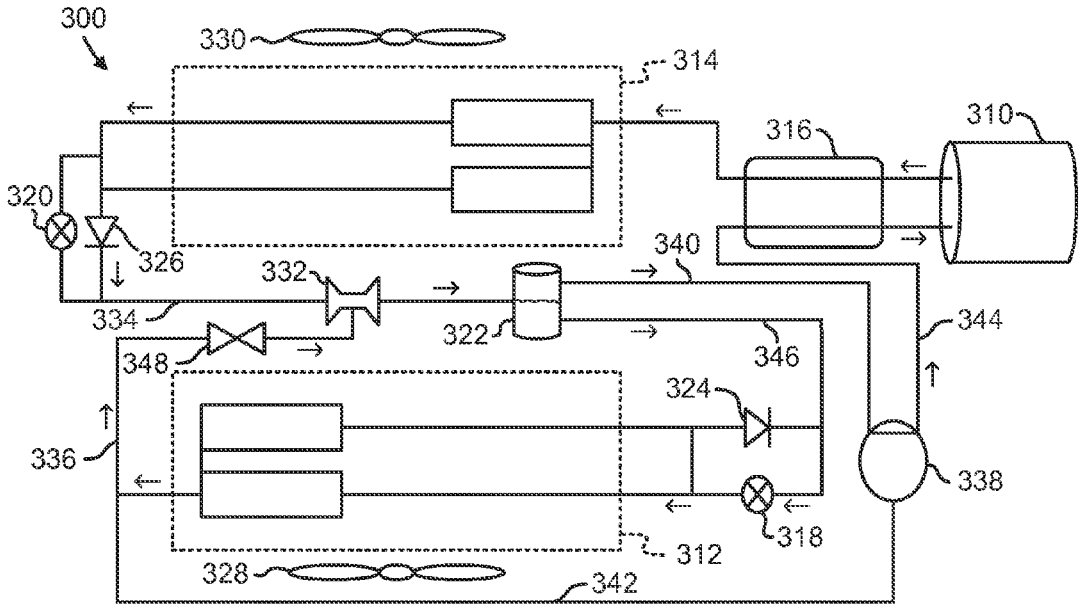
FIGS. 4 and 5 provide schematic views of components of a sealed system for a packaged terminal air conditioner unit according to another exemplary embodiment of the present subject matter.
Figure 5:
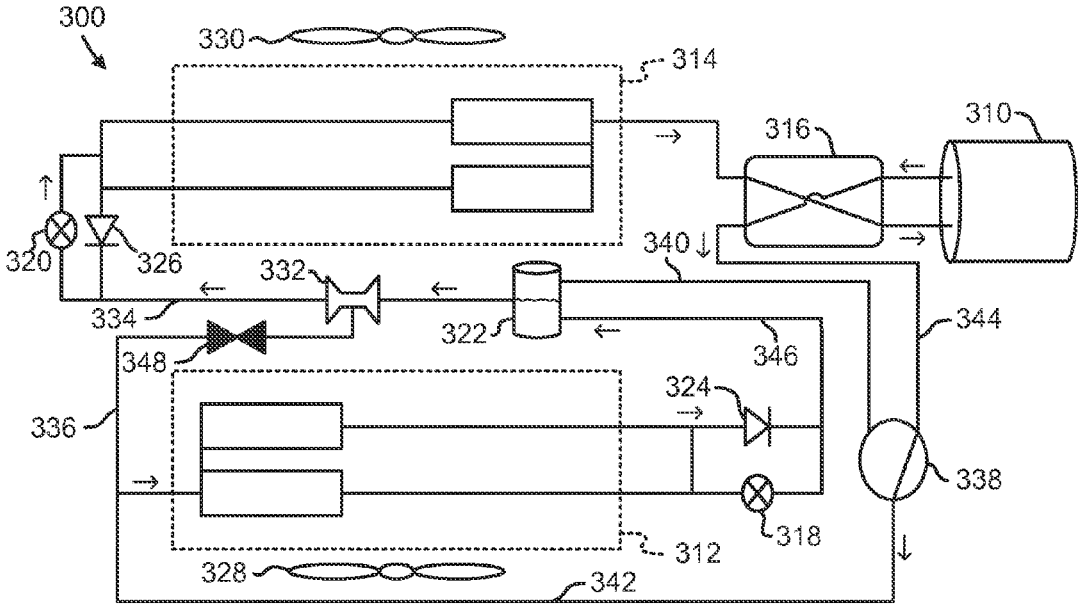

FIGS. 4 and 5 provide schematic views of components of a sealed system 300 for a packaged terminal air conditioner unit according to another exemplary embodiment of the present subject matter. Sealed system 300 may be used with or in any suitable packaged terminal air conditioner unit. For example, sealed system 300 may be used in packaged terminal air conditioner unit 100 (FIG. 1) as sealed system 120. Sealed system 300 is shown operating in a cooling mode in FIG. 4, and sealed system 300 is shown operating in a heating mode in FIG. 5. The unlabeled arrows in FIGS. 4 and 5 indicate the direction of refrigerant flow within adjacent conduits or piping of sealed system 300 in the cooling mode and heating mode, respectively.

Like sealed system 200 (FIGS. 2 and 3), sealed system 300 generally operates in a heat pump cycle. Sealed system 300 includes similar components to sealed system 200 and operates in a similar manner. For example, sealed system 300 includes a compressor 310, an interior heat exchanger or coil 312 and an exterior heat exchanger or coil 314. Sealed system 300 also includes a reversing valve 316 that selectively directs compressed refrigerant from compressor 310 towards either interior coil 312 or exterior coil 314.

As shown in FIG. 4, during operation of sealed system 300, compressor 310 operates to increase a pressure of refrigerant within the compressor 310. In particular, vapor refrigerant from a phase separator 322 is directed to compressor 310 in the cooling mode. Vapor refrigerant from phase separator 322 may be a fluid in the form of a superheated vapor. Compressor 310 is operable to compress the refrigerant, e.g., such that the pressure and temperature of the refrigerant increase and the refrigerant becomes a more superheated vapor.

Exterior coil 314 is disposed downstream of compressor 310 in the cooling mode and acts as a condenser. Thus, exterior coil 314 is operable to reject heat into the exterior atmosphere, e.g., at exterior side portion 114 of casing 110, when sealed system 300 is operating in the cooling mode. Within exterior coil 314, the refrigerant from compressor 310 transfers energy to the exterior atmosphere and condenses into a saturated liquid, liquid vapor mixture and/or subcooled liquid. An exterior air handler or fan 330 positioned adjacent exterior coil 314 may facilitate or urge a flow of air from the exterior atmosphere across exterior coil 314 in order to facilitate heat transfer.

As may be seen in FIGS. 4 and 5, sealed system 300 also includes a phase separator 322 and an injector or ejector 332. Phase separator 322 is configured for separating liquid refrigerant within phase separator 322 from vapor refrigerant within phase separator 322, e.g., in the cooling mode. Phase separator 322 is fluidly coupled to exterior coil 314 via a supply conduit 334. Thus, supply conduit 334 may extend between and fluidly connect exterior coil 314 and phase separator 322 such that refrigerant from exterior coil 314 may flow through supply conduit 334 to phase separator 322, e.g., in the cooling mode.

As shown in FIG. 4, in the cooling mode, ejector 332 is coupled to supply conduit 334 and is configured for introducing or injecting vapor refrigerant from interior coil 312 into supply conduit 334. In particular, ejector 332 may be configured for combining streams of refrigerant via the Venturi effect. Ejector 332 is positioned on supply conduit 334 and receives vapor phase refrigerant from interior coil 312 via a distribution conduit 336 that extends between and fluidly connects interior coil 312 and ejector 332. Ejector 332 directs or urges the vapor phase refrigerant from distribution conduit 336 into supply conduit 334 and refrigerant flowing through supply conduit 334.

Sealed system 300 also includes a three-way valve 338. Three-way valve 338 assists with switching sealed system 300 between the cooling mode and the heating mode, e.g., by modifying the flow of refrigerant between components of sealed system 300, as discussed in greater detail below. Three-way valve 338 may be configured for selectively adjusting the flow of refrigerant between a first connection conduit 340, a second connection conduit 342, a third connection conduit 344.

As may be seen in FIGS. 4 and 5, first connection conduit 340 extends between phase separator 322 and three-way valve 338, second connection (or bypass) conduit 342 extends between three-way valve 338 and distribution conduit 336, and third connection conduit 344 extends between three-way valve 338 and reversing valve 316 or compressor 310. As shown in FIG. 4, in the cooling mode, three-way valve 338 fluidly connects first connection conduit 340 and third connection conduit 344 such that vapor refrigerant from phase separator 322 may flow from phase separator 322 to compressor 310 via first and third connection conduits 340, 344 and three-way valve 338.

In the cooling mode, phase separator 322 receives refrigerant from supply conduit 334 and separates liquid refrigerant from supply conduit 334 and vapor refrigerant from supply conduit 334. The liquid phase refrigerant within phase separator 322 is directed from phase separator 322 to interior coil 312 via a transfer conduit 346 that extends between phase separator 322 and interior coil 312. Conversely, the vapor phase refrigerant within phase separator 322 is directed around interior coil 312 back to compressor 310 such that the vapor phase refrigerant bypasses interior coil 312 in the cooling mode.

A first throttling device 318 is disposed on transfer conduit 346 between phase separator 322 and interior coil 312. In the cooling mode, liquid refrigerant from phase separator 322 travels through first throttling device 318 before flowing through interior coil 312. First throttling device 318 may generally expand the refrigerant, lowering the pressure and temperature thereof. The refrigerant may then be flowed through interior coil 312.

Interior coil 312 is disposed downstream of first throttling device 318 in the cooling mode and acts as an evaporator. Thus, interior coil 312 is operable to heat refrigerant within interior coil 312 with energy from the interior atmosphere, e.g., at interior side portion 112 of casing 110, when sealed system 300 is operating in the cooling mode. For example, within interior coil 312, the refrigerant from first throttling device 318 receives energy from the interior atmosphere and vaporizes into superheated vapor and/or high quality vapor mixture. An interior air handler or fan 328 positioned adjacent interior coil 312 may facilitate or urge a flow of air from the interior atmosphere across interior coil 312 in order to facilitate heat transfer. As discussed above, ejector 332 directs the vapor refrigerant from interior coil 312 into supply conduit 334.

During operation of sealed system 300 in the heating mode, reversing valve 316 reverses the direction of refrigerant flow through sealed system 300, as shown in FIG. 5. Thus, in the heating mode, interior coil 312 is disposed downstream of compressor 310 and acts as a condenser, e.g., such that interior coil 312 is operable to reject heat into the interior atmosphere at interior side portion 112 of casing 110.

As may be seen in FIG. 5, three-way valve 338 fluidly connects second connection conduit 342 and third connection conduit 344 such that refrigerant from compressor 310 may flow from reversing valve 316 to interior coil 312 via second and third connection conduits 342, 344 and three-way valve 338 in the heating mode. In the heating mode, a shutoff valve 348 coupled to distribution conduit 336 is closed and blocks refrigerant flow from interior coil 312 to ejector 332 via distribution conduit 336. A first check valve 324 on transfer conduit 346 also allows refrigerant flow to bypass first throttling device 318, e.g., in the heating mode as shown in FIG. 5. As may be seen in FIG. 5, phase separator 322 and ejector 332 act as conduits to direct refrigerant from interior coil 312 to a second throttling device 320 in the heating mode.

Second throttling device 320 is coupled to supply conduit 334 between ejector 332 and exterior coil 314. In the heating mode, refrigerant from interior coil 312 travels through second throttling device 320 before flowing through exterior coil 314. Second throttling device 320 may generally expand the refrigerant, lowering the pressure and temperature thereof. The refrigerant may then be flowed through exterior coil 314. A second check valve 326 coupled to supply conduit 334 hinders or prevents refrigerant from bypassing second throttling device 320 in the heating mode.

Exterior coil 314 is disposed downstream of second throttling device 320 in the heating mode and acts as an evaporator. Thus, exterior coil 314 is operable to heat refrigerant within exterior coil 314 with energy from the exterior atmosphere, e.g., at exterior side portion 114 of casing 110, when sealed system 300 is operating in the heating mode. For example, within exterior coil 314, the refrigerant from second throttling device 320 receives energy from the exterior atmosphere and vaporizes into superheated vapor and/or high quality vapor mixture. From exterior coil 314, refrigerant is directed back to compressor 310.

Sealed system 300 may assist with operating packaged terminal air conditioner unit 100 efficiently. For example, ejector 332 of sealed system 300 may utilize expansion work of high-pressure refrigerant to compress vapor refrigerant exiting interior coil 312 in the cooling mode. In such a manner, ejector 332 may assist with reducing energy consumption of compressor 310 in the cooling mode. Phase separator 322 also reduces a pressure drop in interior coil 312 by bypassing vapor refrigerant directly to compressor 310 in the cooling mode.

Figure 6:
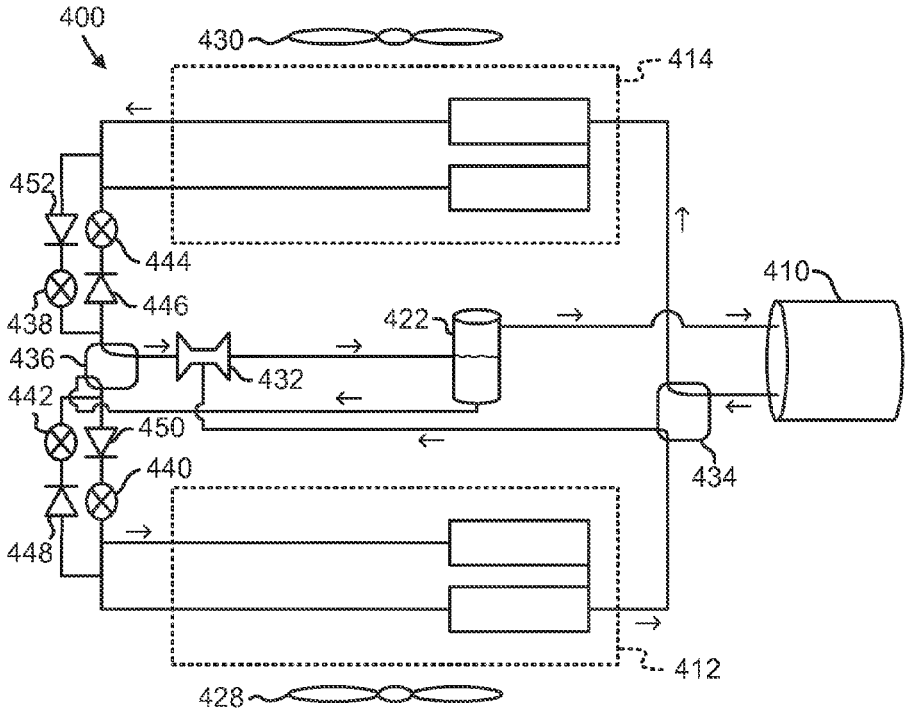
FIGS. 6 and 7 provide schematic views of components of a sealed system for a packaged terminal air conditioner unit according to an additional exemplary embodiment of the present subject matter.
Figure 7:
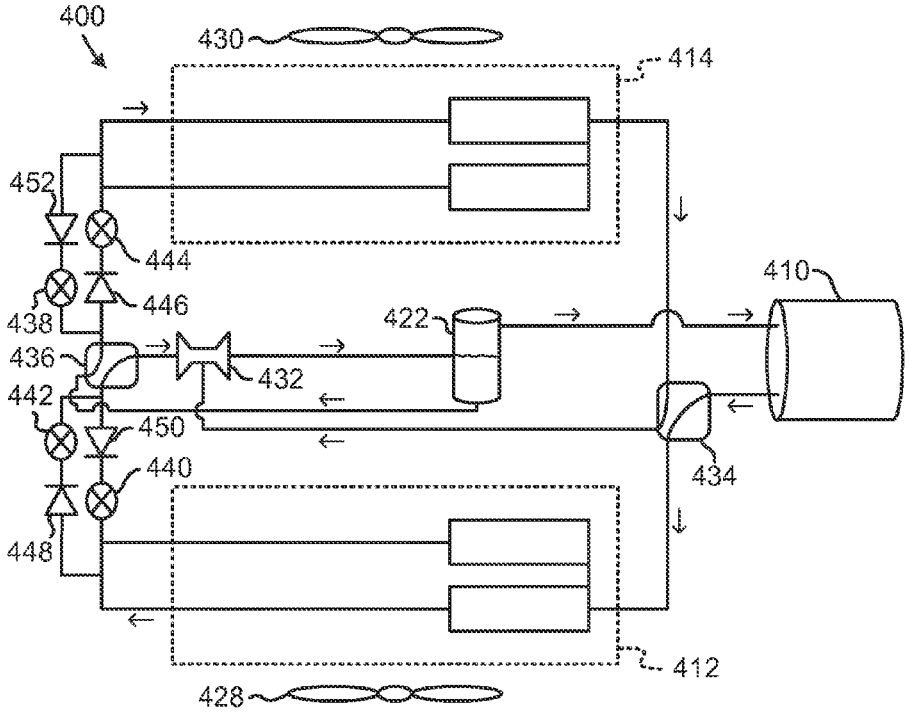

FIGS. 6 and 7 provide schematic views of components of a sealed system 400 for a packaged terminal air conditioner unit according to an additional exemplary embodiment of the present subject matter. Sealed system 400 may be used with or in any suitable packaged terminal air conditioner unit. For example, sealed system 400 may be used in packaged terminal air conditioner unit 100 (FIG. 1) as sealed system 120. Sealed system 400 is shown operating in a cooling mode in FIG. 6, and sealed system 400 is shown operating in a heating mode in FIG. 7. The unlabeled arrows in FIGS. 6 and 7 indicate the direction of refrigerant flow within adjacent conduits or piping of sealed system 400 in the cooling mode and heating mode, respectively.

Like sealed system 200 (FIGS. 2 and 3), sealed system 400 generally operates in a heat pump cycle. Sealed system 400 includes similar components to sealed system 200 and operates in a similar manner. For example, sealed system 400 includes a compressor 410, an interior heat exchanger or coil 412 and an exterior heat exchanger or coil 414. As is generally understood, various conduits may be utilized to flow refrigerant between the various components of sealed system 400.

As shown in FIG. 6, during operation of sealed system 400, compressor 410 operates to increase a pressure of refrigerant within the compressor 410. In particular, vapor refrigerant from a phase separator 422 is directed to compressor 410 in the cooling mode. Vapor refrigerant from phase separator 422 may be a fluid in the form of a superheated vapor. Compressor 410 is operable to compress the refrigerant, e.g., such that the pressure and temperature of the refrigerant increase and the refrigerant becomes a more superheated vapor.

Exterior coil 414 is disposed downstream of compressor 410 in the cooling mode and acts as a condenser. Thus, exterior coil 414 is operable to reject heat into the exterior atmosphere, e.g., at exterior side portion 114 of casing 110, when sealed system 400 is operating in the cooling mode. Within exterior coil 414, the refrigerant from compressor 410 transfers energy to the exterior atmosphere and condenses into a saturated liquid, liquid vapor mixture and/or subcooled liquid. An exterior air handler or fan 430 positioned adjacent exterior coil 414 may facilitate or urge a flow of air from the exterior atmosphere across exterior coil 414 in order to facilitate heat transfer.

As may be seen in FIGS. 6 and 7, sealed system 400 also includes a phase separator 422 and an injector or ejector 432. Phase separator 422 is configured for separating liquid refrigerant within phase separator 422 from vapor refrigerant within phase separator 422. As may be seen in FIG. 6, refrigerant from exterior coil 414 flows through ejector 432 to phase separator 422 in the cooling mode. Ejector 432 is configured for introducing or injecting vapor refrigerant from interior coil 412 into the flow of refrigerant from exterior coil 414. In particular, ejector 432 may be configured for combining streams of refrigerant via the Venturi effect.

In the cooling mode, phase separator 422 receives refrigerant from exterior coil 414 and ejector 432 and separates liquid refrigerant from vapor refrigerant. The liquid phase refrigerant within phase separator 422 is directed from phase separator 422 to interior coil 412. Conversely, the vapor phase refrigerant within phase separator 422 is directed around interior coil 412 back to compressor 410 such that the vapor phase refrigerant bypasses interior coil 412 in the cooling mode. In particular, sealed system 400 includes a first four-way valve 434 and a second four-way valve 436. First and second four-way valves 434, 436 assist with switching sealed system 400 between the cooling mode and the heating mode, e.g., by modifying the flow of refrigerant between components of sealed system 400, as discussed in greater detail below.

As shown in FIG. 6, first four-way valve 434 directs compressed refrigerant from compressor 410 to exterior coil 414 and also directs vapor refrigerant from interior coil 412 to ejector 432 in the cooling mode. Second four-way valve 436 directs refrigerant from exterior coil 414 to ejector 432 and also directs liquid refrigerant from phase separator 422 to interior coil 412 in the cooling mode. Thus, phase separator 422 and first and second four-way valves 434, 436 assist with directing liquid phase refrigerant to interior coil 412 and vapor phase refrigerant around interior coil 412 such that the vapor phase refrigerant bypasses interior coil 412 in the cooling mode.

Sealed system 400 also includes various throttling devices and/or check valves. In particular, sealed system 400 includes a first throttling device 438, a second throttling device 440, a third throttling device 442, a fourth throttling device 444, a first check valve 446, a second check valve 448, a third check valve 450 and a fourth check valve 452. First throttling device 438 is disposed between exterior coil 414 and ejector 432 in the cooling mode. In the cooling mode, refrigerant from exterior coil 414 travels through first throttling device 438 before flowing through ejector 432. First throttling device 438 may generally expand the refrigerant, lowering the pressure and temperature thereof. The refrigerant may then be flowed through ejector 432. It should be understood that, in certain exemplary embodiments, sealed system 400 need not include first throttling device 438 for pre-throttling refrigerant flowing to ejector 432, e.g., in the cooling mode. In addition, sealed system 400 need not include first check valve 446, e.g., in exemplary embodiments that do not include first throttling device 438.

Second throttling device 440 is disposed between phase separator 422 and interior coil 412 in the cooling mode. In the cooling mode, liquid refrigerant from phase separator 422 travels through second throttling device 440 before flowing through interior coil 412. Second throttling device 440 may generally expand the refrigerant, lowering the pressure and temperature thereof. The refrigerant may then be flowed through interior coil 412. In the cooling mode, first check valve 446 may hinder or prevent refrigerant from exterior coil 414 from flowing through fourth throttling device 444, and second check valve 448 may hinder or prevent liquid refrigerant from phase separator 422 from flowing through third throttling device 442.

Interior coil 412 is disposed downstream of second throttling device 440 in the cooling mode and acts as an evaporator. Thus, interior coil 412 is operable to heat refrigerant within interior coil 412 with energy from the interior atmosphere, e.g., at interior side portion 112 of casing 110, when sealed system 400 is operating in the cooling mode. For example, within interior coil 412, the refrigerant from second throttling device 440 receives energy from the interior atmosphere and vaporizes into superheated vapor and/or high quality vapor mixture. An interior air handler or fan 428 positioned adjacent interior coil 412 may facilitate or urge a flow of air from the interior atmosphere across interior coil 412 in order to facilitate heat transfer. As discussed above, ejector 432 directs the vapor refrigerant from interior coil 412 into the flow of refrigerant from exterior coil 414 to phase separator 422.

During operation of sealed system 400 in the heating mode, the direction of refrigerant flow through sealed system 400 is reversed with first and second four-way valves 434, 436, as shown in FIG. 7. Thus, in the heating mode, interior coil 412 is disposed downstream of compressor 410 and acts as a condenser, e.g., such that interior coil 412 is operable to reject heat into the interior atmosphere at interior side portion 112 of casing 110.

As shown in FIG. 7, first four-way valve 434 directs compressed refrigerant from compressor 410 to interior coil 412 and also directs vapor refrigerant from exterior coil 414 to ejector 432 in the heating mode. Second four-way valve 436 directs refrigerant from interior coil 412 to ejector 432 and also directs liquid refrigerant from phase separator 422 to exterior coil 414 in the heating mode. Thus, phase separator 422 and first and second four-way valves 434, 436 assist with directing liquid phase refrigerant to exterior coil 414 and vapor phase refrigerant around exterior coil 414 such that the vapor phase refrigerant bypasses exterior coil 414 in the heating mode.

Third throttling device 442 is disposed between interior coil 412 and ejector 432 in the heating mode. In the heating mode, refrigerant from interior coil 412 travels through third throttling device 442 before flowing through ejector 432. Third throttling device 442 may generally expand the refrigerant, lowering the pressure and temperature thereof. The refrigerant may then be flowed through ejector 432. It should be understood that, in certain exemplary embodiments, sealed system 400 need not include third throttling device 442 for pre-throttling refrigerant flowing to ejector 432, e.g., in the heating mode. In addition, sealed system 400 need not include third check valve 450, e.g., in exemplary embodiments that do not include third throttling device 442.

Fourth throttling device 444 is disposed between phase separator 422 and exterior coil 414 in the heating mode. In the heating mode, liquid refrigerant from phase separator 422 travels through fourth throttling device 444 before flowing through exterior coil 414. Fourth throttling device 444 may generally expand the refrigerant, lowering the pressure and temperature thereof. The refrigerant may then be flowed through exterior coil 414. In the heating mode, third check valve 450 may hinder or prevent refrigerant from interior coil 412 from flowing through second throttling device 440, and fourth check valve 452 may hinder or prevent liquid refrigerant from phase separator 422 from flowing through first throttling device 438.

Exterior coil 414 is disposed downstream of fourth throttling device 444 in the heating mode and acts as an evaporator. Thus, exterior coil 414 is operable to heat refrigerant within exterior coil 414 with energy from the exterior atmosphere, e.g., at exterior side portion 114 of casing 110, when sealed system 400 is operating in the heating mode. For example, within exterior coil 414, the refrigerant from fourth throttling device 444 receives energy from the exterior atmosphere and vaporizes into superheated vapor and/or high quality vapor mixture. As discussed above, ejector 432 directs the vapor refrigerant from exterior coil 414 into the flow of refrigerant from interior coil 412 to phase separator 422.

Sealed system 400 may assist with operating packaged terminal air conditioner unit 100 efficiently. For example, ejector 432 of sealed system 400 may utilize expansion work of high-pressure refrigerant to compress vapor refrigerant exiting interior and exterior coils 412, 414 in the cooling and heating modes, respectively. In such a manner, ejector 432 may assist with reducing energy consumption of compressor 410 in the cooling and heating modes. Phase separator 422 also reduces a pressure drop in interior and exterior coils 412, 414 by bypassing vapor refrigerant directly to compressor 410 in the cooling and heating modes.

Figure 8:
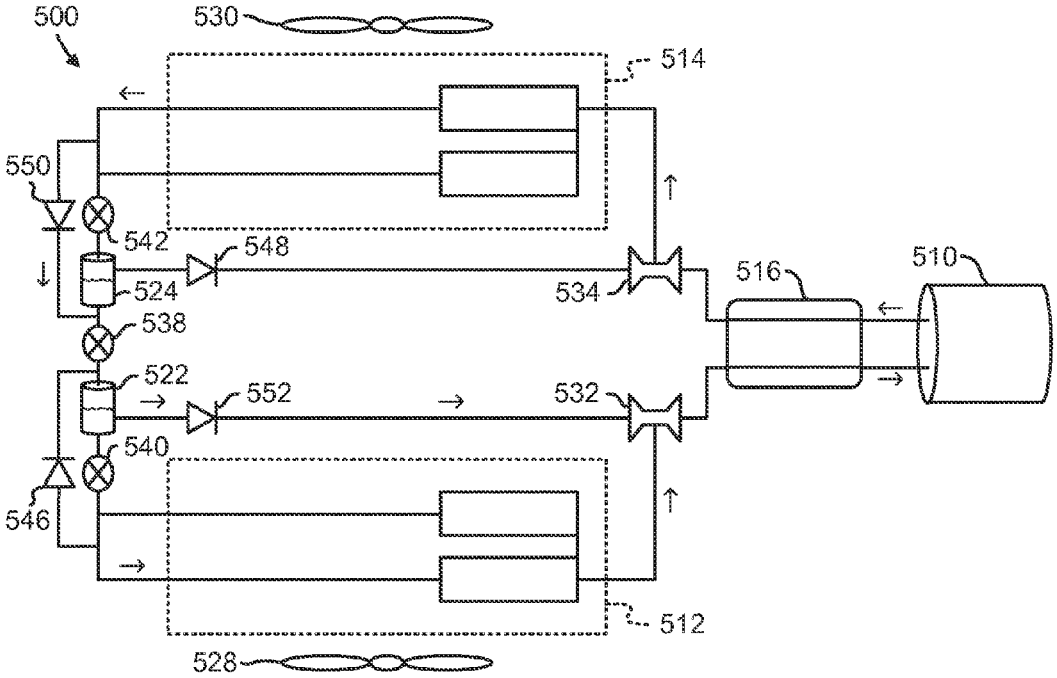
FIGS. 8 and 9 provide schematic views of components of a sealed system for a packaged terminal air conditioner unit according to yet another exemplary embodiment of the present subject matter.
Figure 9:
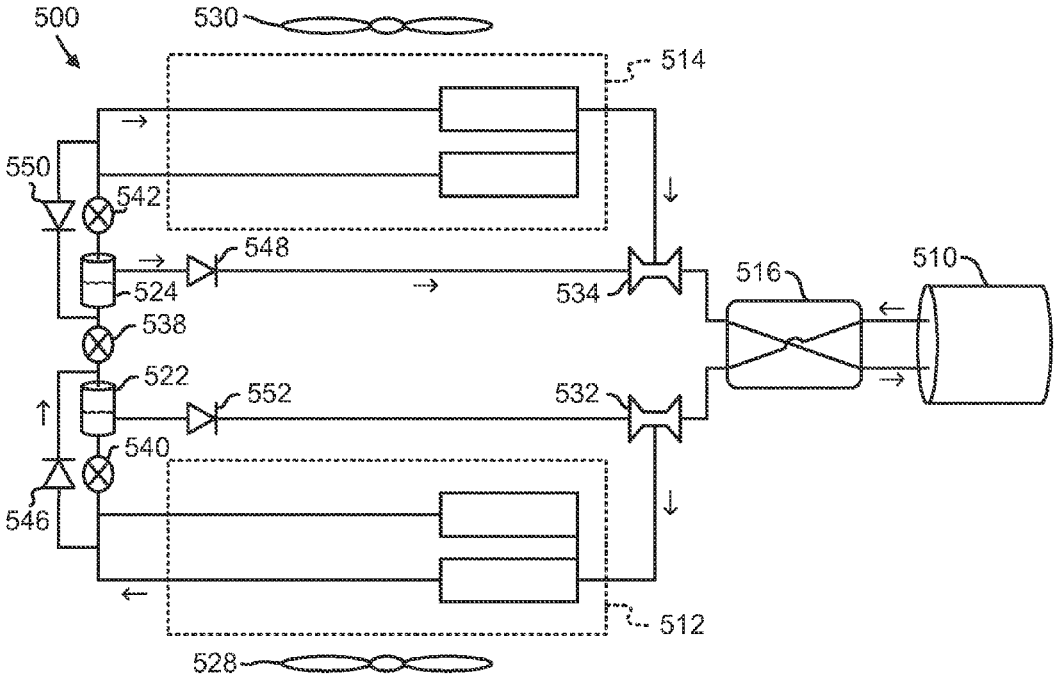

FIGS. 8 and 9 provide schematic views of components of a sealed system 500 for a packaged terminal air conditioner unit according to yet another exemplary embodiment of the present subject matter. Sealed system 500 may be used with or in any suitable packaged terminal air conditioner unit. For example, sealed system 500 may be used in packaged terminal air conditioner unit 100 (FIG. 1) as sealed system 120. Sealed system 500 is shown operating in a cooling mode in FIG. 8, and sealed system 500 is shown operating in a heating mode in FIG. 9. The unlabeled arrows in FIGS. 8 and 9 indicate the direction of refrigerant flow within adjacent conduits or piping of sealed system 500 in the cooling mode and heating mode, respectively.

Like sealed system 200 (FIGS. 2 and 3), sealed system 500 generally operates in a heat pump cycle. Sealed system 500 includes similar components to sealed system 200 and operates in a similar manner. For example, sealed system 500 includes a compressor 510, an interior heat exchanger or coil 512 and an exterior heat exchanger or coil 514. Sealed system 500 also includes a reversing valve 516 that selectively directs compressed refrigerant from compressor 510 towards either interior coil 512 or exterior coil 514. As is generally understood, various conduits may be utilized to flow refrigerant between the various components of sealed system 500.

As shown in FIG. 8, during operation of sealed system 500, compressor 510 operates to increase a pressure of refrigerant within the compressor 510. In particular, vapor refrigerant from a first phase separator 522 and interior coil 512 is directed to compressor 510 via a first injector or ejector 532. The vapor refrigerant may be a fluid in the form of a superheated vapor. Compressor 510 is operable to compress the refrigerant, e.g., such that the pressure and temperature of the refrigerant increase and the refrigerant becomes a more superheated vapor.

Exterior coil 514 is disposed downstream of compressor 510 in the cooling mode and acts as a condenser. Thus, exterior coil 514 is operable to reject heat into the exterior atmosphere, e.g., at exterior side portion 114 of casing 110, when sealed system 500 is operating in the cooling mode. Within exterior coil 514, the refrigerant from compressor 510 transfers energy to the exterior atmosphere and condenses into a saturated liquid and/or liquid vapor mixture. An exterior air handler or fan 530 positioned adjacent exterior coil 514 may facilitate or urge a flow of air from the exterior atmosphere across exterior coil 514 in order to facilitate heat transfer.

As may be seen in FIGS. 8 and 9, sealed system 500 also includes a first phase separator 522, a second phase separator 524, a first injector or ejector 532 and a second injector or ejector 534. First and second phase separators 522, 524 are configured for separating liquid refrigerant within first and second phase separators 522, 524 from vapor refrigerant within first and second phase separators 522, 524. In the cooling mode, first phase separator 522 receives refrigerant from exterior coil 514 and separates liquid refrigerant from vapor refrigerant. The liquid phase refrigerant within first phase separator 522 is directed from first phase separator 522 to interior coil 512. Conversely, the vapor phase refrigerant within first phase separator 522 is directed around interior coil 512 back to compressor 510 such that the vapor phase refrigerant bypasses interior coil 512 in the cooling mode.

As may be seen in FIG. 8, vapor refrigerant from first phase separator 522 flows through first ejector 532 to compressor 510 in the cooling mode. First ejector 532 is configured for introducing or injecting vapor refrigerant from interior coil 512 into the flow of vapor refrigerant from first phase separator 522. In particular, first ejector 532 may be configured for combining streams of refrigerant via the Venturi effect. As also may be seen in FIG. 8, compressed refrigerant from compressor 510 flows through second ejector 534 to exterior coil 514 in the cooling mode. Thus, second ejector 534 acts as a conduit to direct compressed refrigerant from compressor 510 to exterior coil 514 in the cooling mode.

Sealed system 500 also includes various throttling devices and/or check valves. In particular, sealed system 500 includes a first throttling device 538, a second throttling device 540, a third throttling device 542, a first check valve 546, a second check valve 548, a third check valve 550 and a fourth check valve 552. First throttling device 538 is disposed between exterior coil 514 and first phase separator 522 in the cooling mode. In the cooling mode, refrigerant from exterior coil 514 travels through first throttling device 538 before flowing to first phase separator 522. First throttling device 538 may generally expand the refrigerant, lowering the pressure and temperature thereof. The refrigerant may then be flowed to first phase separator 522.

Second throttling device 540 is disposed between first phase separator 522 and interior coil 512 in the cooling mode. In the cooling mode, liquid refrigerant from first phase separator 522 travels through second throttling device 540 before flowing through interior coil 512. Second throttling device 540 may generally expand the refrigerant, lowering the pressure and temperature thereof. The refrigerant may then be flowed through interior coil 512. In the cooling mode, first check valve 546 may hinder or prevent refrigerant from exterior coil 514 from bypassing first phase separator 522 and/or second throttling device 540, and second check valve 548 may hinder or prevent compressed refrigerant from compressor 510 from bypassing exterior coil 514.

Interior coil 512 is disposed downstream of second throttling device 540 in the cooling mode and acts as an evaporator. Thus, interior coil 512 is operable to heat refrigerant within interior coil 512 with energy from the interior atmosphere, e.g., at interior side portion 112 of casing 110, when sealed system 500 is operating in the cooling mode. For example, within interior coil 512, the refrigerant from second throttling device 540 receives energy from the interior atmosphere and vaporizes into superheated vapor and/or high quality vapor mixture. An interior air handler or fan 528 positioned adjacent interior coil 512 may facilitate or urge a flow of air from the interior atmosphere across interior coil 512 in order to facilitate heat transfer. As discussed above, first ejector 532 directs the vapor refrigerant from interior coil 512 into the flow of vapor refrigerant from first phase separator 522.

During operation of sealed system 500 in the heating mode, reversing valve 516 reverses the direction of refrigerant flow through sealed system 500, as shown in FIG. 9. Thus, in the heating mode, interior coil 512 is disposed downstream of compressor 510 and acts as a condenser, e.g., such that interior coil 512 is operable to reject heat into the interior atmosphere at interior side portion 112 of casing 110.

In the heating mode, second phase separator 524 receives refrigerant from interior coil 512 and separates liquid refrigerant from vapor refrigerant. The liquid phase refrigerant within second phase separator 524 is directed from second phase separator 524 to exterior coil 514. Conversely, the vapor phase refrigerant within second phase separator 524 is directed around exterior coil 514 back to compressor 510 such that the vapor phase refrigerant bypasses exterior coil 514 in the heating mode.

As may be seen in FIG. 9, vapor refrigerant from second phase separator 524 flows through second ejector 534 to compressor 510 via reversing valve 516 in the heating mode. Second ejector 534 is configured for introducing or injecting vapor refrigerant from exterior coil 514 into the flow of vapor refrigerant from second phase separator 524. In particular, second ejector 534 may be configured for combining streams of refrigerant via the Venturi effect. As also may be seen in FIG. 9, compressed refrigerant from compressor 510 flows through first ejector 532 to interior coil 512 in the heating mode. Thus, first ejector 532 acts as a conduit to direct compressed refrigerant from compressor 510 to interior coil 512 in the heating mode.

First throttling device 538 is disposed between interior coil 512 and second phase separator 524 in the heating mode. In the heating mode, refrigerant from interior coil 512 travels through first throttling device 538 before flowing to second phase separator 524. First throttling device 538 may generally expand the refrigerant, lowering the pressure and temperature thereof. The refrigerant may then be flowed to second phase separator 524.

Third throttling device 542 is disposed between second phase separator 524 and exterior coil 514 in the heating mode. In the heating mode, liquid refrigerant from second phase separator 524 travels through third throttling device 542 before flowing through exterior coil 514. Third throttling device 542 may generally expand the refrigerant, lowering the pressure and temperature thereof. The refrigerant may then be flowed through exterior coil 514. In the heating mode, third check valve 550 may hinder or prevent refrigerant from interior coil 512 from bypassing second phase separator 524 and/or third throttling device 542, and fourth check valve 552 may hinder or prevent compressed refrigerant from compressor 510 from bypassing interior coil 512.

Exterior coil 514 is disposed downstream of third throttling device 542 in the heating mode and acts as an evaporator. Thus, exterior coil 514 is operable to heat refrigerant within exterior coil 514 with energy from the exterior atmosphere, e.g., at exterior side portion 114 of casing 110, when sealed system 500 is operating in the heating mode. For example, within exterior coil 514, the refrigerant from third throttling device 542 receives energy from the exterior atmosphere and vaporizes into superheated vapor and/or high quality vapor mixture. As discussed above, second ejector 534 directs the vapor refrigerant from exterior coil 514 into the flow of vapor refrigerant from second phase separator 524.

Sealed system 500 may assist with operating packaged terminal air conditioner unit 100 efficiently. For example, first and second ejectors 532, 534 of sealed system 500 may utilize expansion work of high-pressure refrigerant to compress vapor refrigerant exiting interior coil 512 in the cooling mode and exterior coil 514 in the heating mode. In such a manner, first and second ejectors 532, 534 may assist with reducing energy consumption of compressor 510 in the cooling and heating modes. First and second phase separators 522, 524 also reduces a pressure drop in interior coil 512 and exterior coil 514 by bypassing vapor refrigerant directly to compressor 510 in the cooling and heating modes.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A packaged terminal air conditioner unit, comprising:

a casing;

a compressor positioned within the casing, the compressor operable to increase a pressure of a refrigerant;

an interior coil positioned within the casing;

an exterior coil positioned within the casing opposite the interior coil;

a phase separator positioned within the casing, the phase separator configured for separating liquid refrigerant from vapor refrigerant;

a reversing valve positioned within the casing, the reversing valve in fluid communication with the compressor in order to receive compressed refrigerant from the compressor, the reversing valve configured for selectively directing the compressed refrigerant in order from the compressor, through the reversing valve, and to the exterior coil in a cooling mode, the reversing valve further configured for selectively directing the compressed refrigerant in order from the compressor, through the reversing valve, and to the phase separator in a heating mode;

a supply conduit extending between the exterior coil and the phase separator;

an ejector coupled to the supply conduit;

a distribution conduit extending between the interior coil and the ejector;

a three-way valve;

a first connection conduit extending between the phase separator and the three-way valve;

a second connection conduit extending between the three-way valve and the interior coil; and a third connection conduit extending between the three-way valve and the exterior coil.

2. The packaged terminal air conditioner unit of claim 1, further comprising a check valve coupled to the supply conduit, the check valve positioned between the exterior coil and the ejector on the supply conduit.

3. The packaged terminal air conditioner unit of claim 1, further comprising a throttling device coupled to the third connection conduit, the throttling device positioned between the three-way valve and the exterior coil on the third connection conduit.

4. The packaged terminal air conditioner unit of claim 3, wherein the throttling device is a capillary tube.

5. The packaged terminal air conditioner unit of claim 1, further comprising a check valve and a throttling device coupled to the second connection conduit, the check valve and the throttling device positioned between the three-way valve and the interior coil on the second connection conduit.

6. The packaged terminal air conditioner unit of claim 5, wherein the check valve and the throttling device are plumbed in parallel on the second connection conduit.

7. The packaged terminal air conditioner unit of claim 5, wherein the throttling device is a capillary tube.

8. The packaged terminal air conditioner unit of claim 1, wherein, in the cooling mode, a flow of liquid refrigerant from the exterior coil flows through the ejector such that the ejector draws vapor refrigerant from the distribution conduit into the flow of liquid refrigerant and a combined flow of liquid and vapor refrigerant flows from the ejector to the phase separator, liquid refrigerant from the phase separator flowing through the three-way valve to the interior coil via the second connection conduit in the cooling mode.

9. The packaged terminal air conditioner unit of claim 1, wherein, in the heating mode, compressed refrigerant from the compressor flows through the phase separator and the ejector to the interior coil.

10. A packaged terminal air conditioner unit, comprising:

a casing extending between an exterior side portion and an interior side portion;

a compressor positioned within the casing, the compressor operable to compress a refrigerant;

an interior coil positioned within the casing at the interior side portion of the casing;

an exterior coil positioned within the casing at the exterior side portion of the casing;

a reversing valve in fluid communication with the compressor in order to receive compressed refrigerant from the compressor;

a phase separator positioned within the casing, the phase separator configured for separating liquid refrigerant from vapor refrigerant; and an ejector positioned within the casing;

wherein, the packaged terminal air conditioner unit is configured such that, in a cooling mode, a flow of liquid refrigerant from the exterior coil flows through the ejector and the ejector draws vapor refrigerant from the interior coil into the flow of liquid refrigerant and a combined flow of liquid and vapor refrigerant flows in order from the ejector to the phase separator, vapor refrigerant from the phase separator flowing to the compressor and liquid refrigerant from the phase separator flowing to the interior coil in the cooling mode; and the packaged terminal air conditioner unit is also configured such that, in a heating mode, compressed refrigerant in order from the compressor flows through the phase separator and the ejector to the interior coil.

11. The packaged terminal air conditioner unit of claim 10, further comprising a check valve coupled to a conduit that extends between the exterior coil and the ejector.

12. The packaged terminal air conditioner unit of claim 10, wherein the first throttling device is coupled to a conduit that extends between the three-way valve and the exterior coil.

13. The packaged terminal air conditioner unit of claim 12, wherein the throttling device is a capillary tube.

14. The packaged terminal air conditioner unit of claim 10, further comprising further comprising a check valve, a wherein the check valve and the first throttling device are coupled to a conduit that extends between the three-way valve and the interior coil.

15. The packaged terminal air conditioner unit of claim 14, wherein the check valve and the throttling device are plumbed in parallel on the conduit.

16. The packaged terminal air conditioner unit of claim 14, wherein the throttling device is a capillary tube.

17. The packaged terminal air conditioner unit of claim 10, further comprising a three-way valve positioned within the casing, the three-way valve configured for directing refrigerant from the phase separator towards a first throttling device positioned upstream of the interior coil in a cooling mode, the three-way valve configured for directing refrigerant from the interior coil towards a second throttling device positioned upstream of the exterior coil in a heating mode.

* * * * *